US009975329B2

(12) United States Patent
Vidal Fortia et al.

(10) Patent No.: US 9,975,329 B2
(45) Date of Patent: May 22, 2018

(54) PRINTHEAD CONTROL SYSTEM AND INKJET PRINTER SYSTEM

(71) Applicant: Hewlett-Packard Development Company, L.P., Houston, TX (US)

(72) Inventors: Joan Vidal Fortia, Barcelona (ES); Lluis Abello Rosello, Tarragona (ES); Ron Burns, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days. days.

(21) Appl. No.: 15/543,543

(22) PCT Filed: Apr. 24, 2015

(86) PCT No.: PCT/US2015/027587
§ 371 (c)(1),
(2) Date: Jul. 13, 2017

(87) PCT Pub. No.: WO2016/171728
PCT Pub. Date: Oct. 27, 2016

(65) Prior Publication Data
US 2017/0361607 A1 Dec. 21, 2017

(51) Int. Cl.
*B41J 2/045* (2006.01)
*B41J 2/21* (2006.01)
*B41J 2/145* (2006.01)

(52) U.S. Cl.
CPC ..... *B41J 2/04535* (2013.01); *B41J 2/04586* (2013.01); *B41J 2/145* (2013.01); *B41J 2/2142* (2013.01)

(58) Field of Classification Search
CPC .... B41J 2/04535; B41J 2/04586; B41J 2/145; B41J 2/2142
See application file for complete search history.

(56) References Cited

U.S. PATENT DOCUMENTS

2015/0328882 A1* 11/2015 Van Sas ..... B41J 2/04541 347/10

* cited by examiner

*Primary Examiner* — Thinh H Nguyen
(74) *Attorney, Agent, or Firm* — Dierker & Kavanaugh, P.C.

(57) ABSTRACT

The present disclosure relates to a printhead control system for a printer, wherein the printer includes at least one printhead comprising a plurality of nozzles for ejecting printing fluid, wherein the nozzles include high drop weight nozzles and low drop weight nozzles ejecting drops of different drop weight, and are each arranged to eject printing fluid on a print medium such as to print images in frame areas of the print medium and such as to clean nozzles in spit bar areas of the print medium; the printer further includes a transport unit for moving the print medium relative to the printhead, wherein the print medium includes frame areas for printing images and spit bar areas for cleaning the nozzles; the printhead control device including: a module to determine a first group of said nozzles located over a frame area of the print medium and a second group of said nozzles located over a spit bar area of the print medium; a module to operate the high drop weight nozzles of the first group such as to eject printing fluid and print an image in the frame area; a module to operate disable the low drop weight nozzles of the first group such as to not eject printing fluid in the frame area; and a module to operate the high drop weight nozzles and the low drop weight nozzles of the second group such as to alternately eject printing fluid in the spit bar area.

15 Claims, 7 Drawing Sheets

PRINTHEAD CONTROL SYSTEM AND INKJET PRINTER SYSTEM

BACKGROUND

Inkjet printers with Dual Drop Weight (DDW) can be operated using high drop weight (HDW) nozzles and low drop weight (LDW) nozzles depending on the desired speed and quality of printing. For example, by doubling the number of activators, such as for example piezo activators or resistors used to fire nozzles or by otherwise modifying the activators, the additional or modified activators can be used in several ways to build different types of printheads. One possibility is to have half of the nozzles eject larger drops (HDW nozzles) than the other half (LDW nozzles).

For this purpose, address data protocols can be used to provide methods of addressing the activators, such as to enable different firing order and firing frequency when operating the nozzles. In an example, the data interface to a printhead die including nozzles may support addressing all activators up to a certain frequency, such as 72 KHz, or half of the activators at double frequency, such as 144 KHz.

Thus, two print modes may be provided: a high quality mode (72 KHz) that uses both the high drop weight (HDW) and the low drop weight (LDW) nozzles and a high speed mode (144 KHz) that fires just high drop weight (HDW) nozzles doubling the firing frequency. In the high speed mode, the low drop weight (LDW) nozzles are out of cap without firing any drop. In order to avoid decap issues, print spit bars can be arranged between image frames for cleaning the nozzles. For example, print spit bars can be provided in the form of bands on a print target, such as for example print medium, located between and along the side of frames containing printed images. The nozzles eject ink inside the print spit bars such as to clean the nozzles and avoid nozzle clogging or variations in the amount of ink ejected by the nozzles, without affecting the frames including the images.

DESCRIPTION OF DRAWINGS

Examples of this disclosure are described with reference to the drawings which are provided for illustrative purposes, in which.

DESCRIPTION OF EXAMPLES

Figure 1:
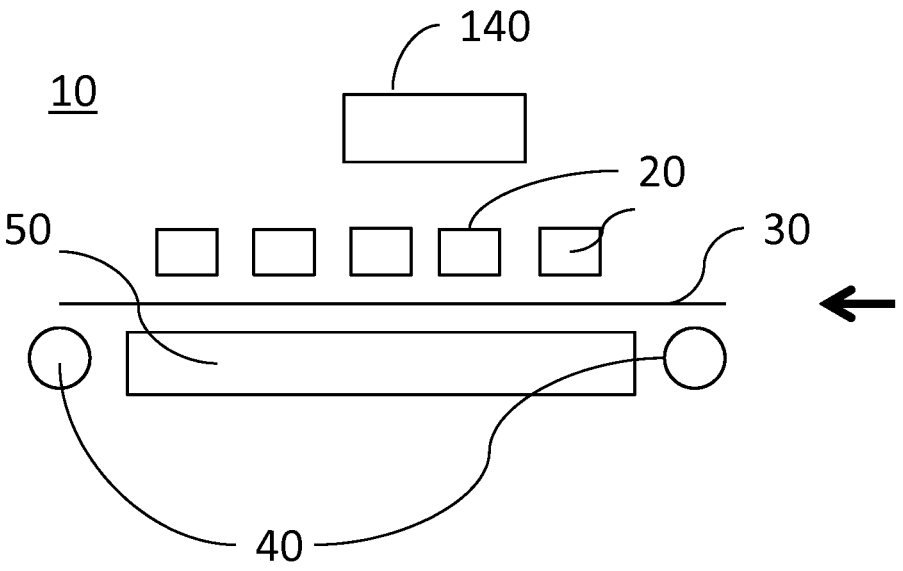
FIG. 1 shows an example of an inkjet printer system.

According to one example, this disclosure provides an inkjet printer system for printing images on a printing paper or other print medium. In this respect, the print medium may for example include any print target used for 2D or 3D printing, for example a bed or build material suitable for 3D printing. As schematically illustrated in FIG. 1, the inkjet printer system 10 can include a plurality of print bars 20 which are arranged close to a print medium 30. The print medium 30 is moved relative to the print bars 20 by a transport unit 40. The transport unit 40 can include different components for moving the print medium 30, such as for example rollers and motors for feeding the print medium 30 along a printing surface 50 close to the print bars 20. In the example shown in FIG. 1, the printing zone 50 represents a flat surface, but other examples may include different shapes of printing zones 50, such as for example an arched print medium paths for stabilizing the print medium 30 moving along the printing zone 50.

Figure 2:
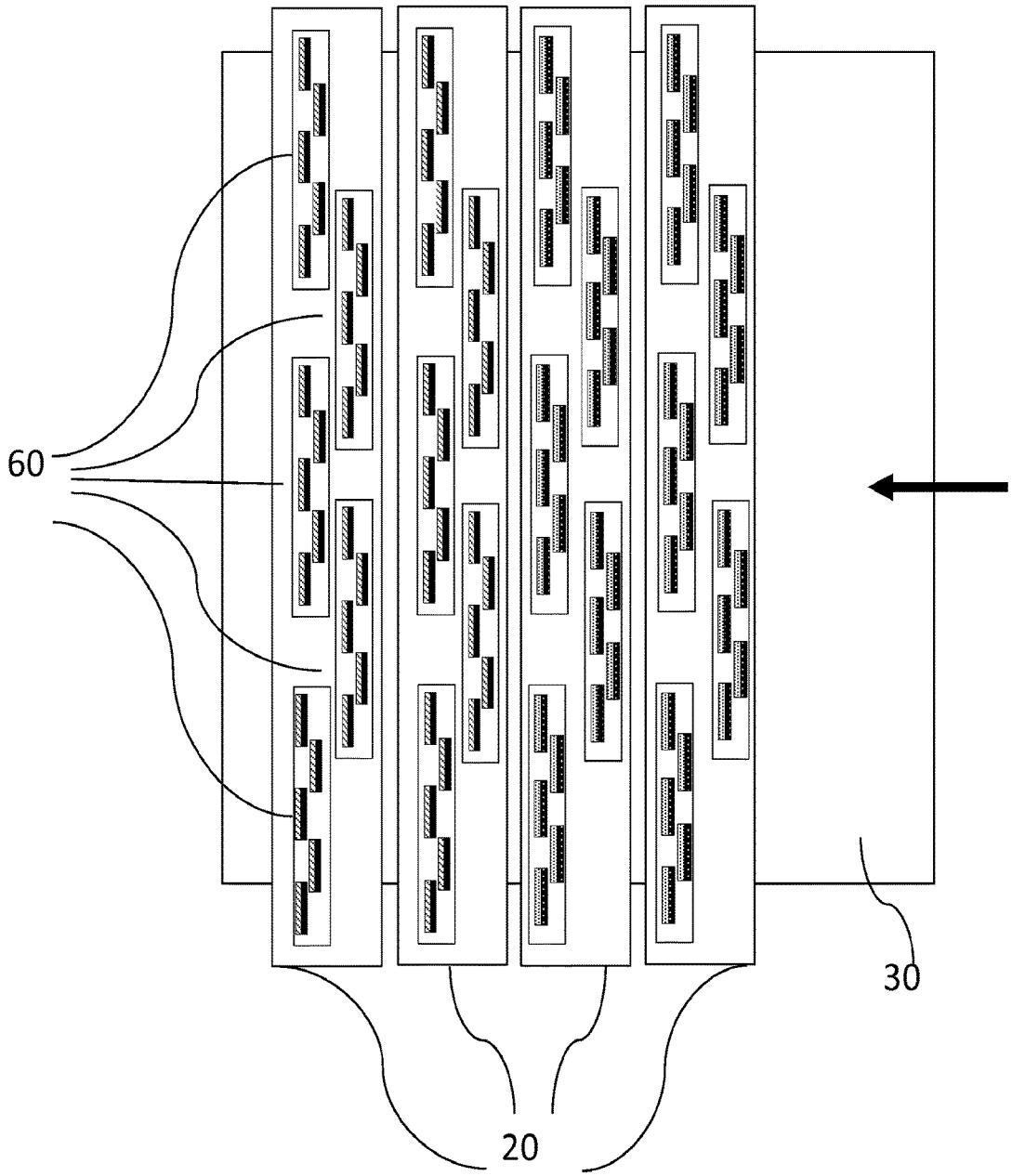
FIG. 2 provides a different schematic view on the print medium and print bars illustrated in the example of FIG. 1.

FIG. 2 provides a different schematic view on the print medium 30 and print bars 20 illustrated in FIG. 1. Each of the print bars 20 can include a plurality of printheads 60. In the example shown in FIG. 2, five printheads 60 are arranged in each of four print bars 20 such as to cover the full width of the print medium 30. Further, in this example, each printhead 60 includes five dies, each die having two parallel nozzle trenches. The plurality of print bars 20 can be used to provide redundancy and/or different colors, such as for example CMYK colors.

Figure 3:
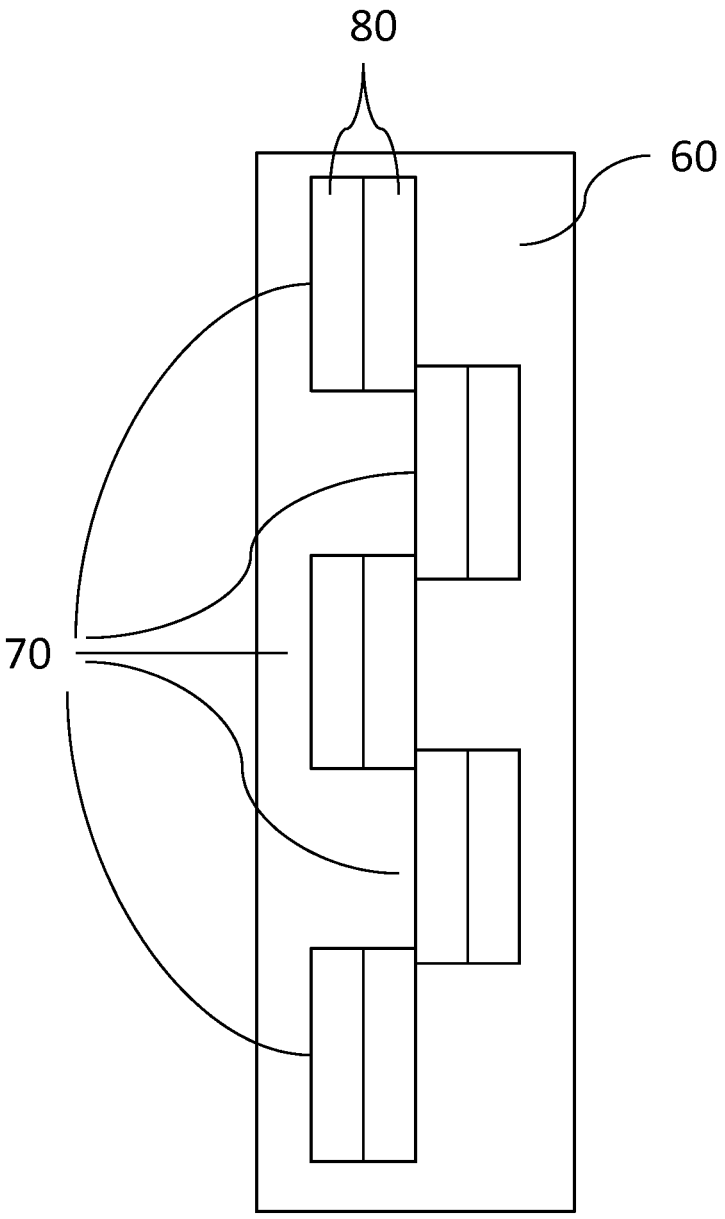
FIG. 3 shows a printhead including a plurality of dies according to one example.
Figure 4:
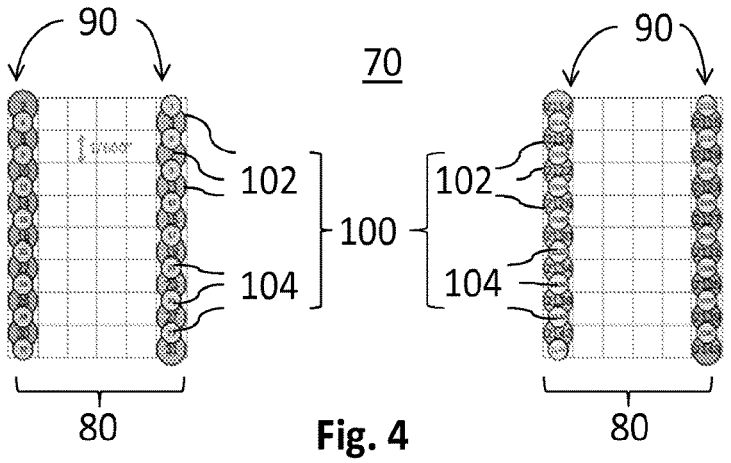
FIG. 4 shows a die comprising two trenches with differently sized nozzles according to one example.

FIG. 3 shows how each of the printheads 60 can include a plurality of dies 70, and each of the dies 70 can include two or more trenches 80. One example of a die 70 is schematically illustrated in FIG. 4, wherein the die 70 includes two trenches 80 each comprising two rows 90 (or columns) of differently sized nozzles 100. More specifically, FIGS. 2 to 4 show an example of a nozzle arrangement providing dual drop weight capability. The distance between the two trenches 80 can, for example, be 52 columns at 600 dpi. Moreover, the distance between the two rows of nozzles 90 inside each of the trenches 80 can, for example, be 5 columns at 600 dpi.

FIGS. 1 to 4 hence show an example of an inkjet printer system 10 for printing images on a print medium 30, wherein the printer system 10 comprises at least one printhead 60 including a plurality of nozzles 100 for ejecting ink or another printing fluid. The nozzles include high drop weight nozzles 102 and low drop weight nozzles 104 and are each arranged above the print medium 30 such as to eject ink on the print medium 30. As explained above, a transport unit 40 moves the print medium 30 relative to the printhead 60.

Figure 5:
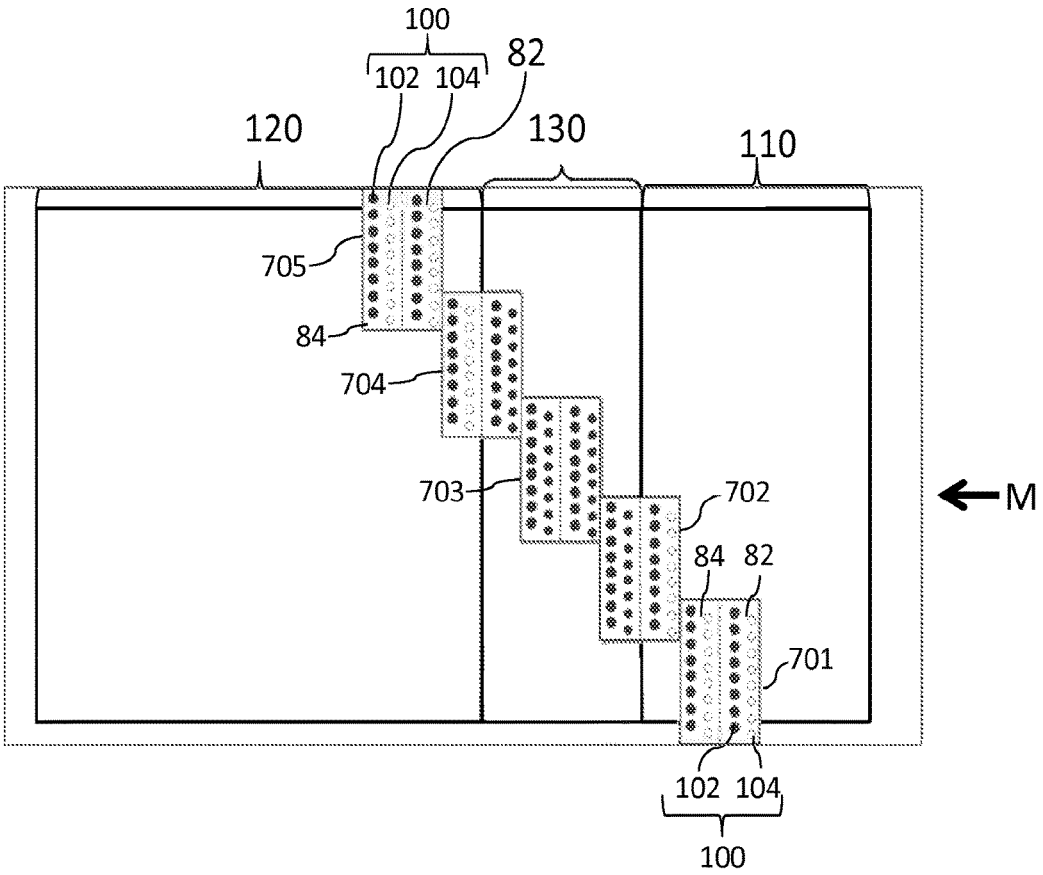
FIG. 5 shows an example of nozzles arranged close to a print medium having frame areas and spit bar areas.

FIG. 5 shows a different arrangement of nozzles 100 over the print medium 30, wherein a plurality of dies 701, 702, 703, 704, 705 each include two trenches 80, and wherein each of the trenches includes one row comprising low drop weight nozzles 104 and one row comprising high drop weight nozzles 102.

An arrow indicates the direction of movement M of the print medium 30. The print medium 30 is divided into frame areas 110, 120 for printing images and spit bar areas 130 for cleaning the nozzles 100. More specifically, print data defines images which are printed in frame areas 110, 120 of the print medium 30, and further print data is used to print in spit bar areas 130 such as to clean the nozzles by ejecting ink inside the spit bar areas 130. Thus, depending on the print data being printed, an image is printed in a frame area 110, 120 or the nozzles 100 are cleaned in a spit bar area 130. In other words, the data being printed depends on whether the printed area on the print medium 30 represents a frame area 110, 120 or a spit bar area 130, respectively. For example, in a high speed mode of the inkjet printer 10, the images are printed in the frame areas 110, 120 using the high drop weight nozzles 102 but not the low drop weight nozzles 104. For example, in the high speed mode, the low drop weight nozzles 104 located over a frame area 110, 120 are disabled not firing any drop. If the low drop weight nozzles 100 are not used for an extended period of time, it might be advisable to perform servicing such as to repeatedly clean the nozzles while they are not used for any printing frame, to avoid nozzle clogging or variations in the amount of ink ejected by the nozzles. In order to avoid such issues (also referred to as "decap issues"), print spit bar areas 130 are provided between frame areas 110, 120 and the nozzles 100 are operated to clean the nozzles 100 inside the spit bar areas 130 of the print medium 30.

For this purpose, the inkjet printer system 10 shown in FIG. 1 comprises a printhead control device 140 which is connected to the printheads 60 of the inkjet printer system 10 which includes a program module to determine a first group of nozzles 100 located in a frame area 110, 120 and a second group of nozzles 100 located in the spit bar area 130 of the print medium 30; and a program module to operate the high drop weight nozzles 102 of the first group such as to eject ink and print an image in the frame area 110, 120. By contrast, a program module may disable the low drop weight nozzles 104 of the first group such as not to eject ink in the frame area 110, 120; and a program module may operate the high drop weight nozzles 102 and the low drop weight nozzles 104 of the second group such as to alternately eject ink in the spit bar area 130.

In other words, just the high drop weight nozzles 102 are used during the print job when printing images in the frame areas 110, 120. Then, when the nozzles arrive over a spit bar area 130 located between frame areas 110, 120, the high drop weight nozzles 102 and the low drop nozzles 104 are operated to alternately eject ink in the spit bar area 130. In this way, both the high drop weight nozzles 102 and the low drop nozzles 104 are cleaned inside the spit bar area 130 such as to avoid decap issues, whereas just the high drop weight nozzles 102 are used to print images in the frame areas 110, 120, for example during a fast mode of printing. An example of performing this operation is described below by reference to FIG. 5 wherein the print medium direction is illustrated by arrow M. Looking at the dies in the print medium direction M, each die includes a leading trench 82 and a trailing trench 84. Further, each trench includes high drop weight nozzles 102 and low drop weight nozzles 104 wherein nozzles used for printing are represented by a full black dot and disabled nozzles are represented by a (white) circle. Further, in the direction of media movement, die 701 is considered as first die, and die 705 is considered as fifth (or last) die.

Considering the configuration shown in FIG. 5, first die 701 is printing an image in the frame area 110 in high speed mode, and is thus printing using just high drop weight nozzles 102. Leading trench 82 of the second die 702 has left the spit bar area 130, starts printing an image in the frame area 110 in high speed mode, and thus uses just the high drop weight nozzles 100. The trailing trench 80 of the second 702 is over the spit bar area 130 and is printing columns in the spit bar area 130 by alternating the high drop weight nozzles 102 and the low drop weight nozzles 104 of the trailing trench. Third die 703 is completely inside the spit bar area 130. It follows that both trenches 82, 84 of the third die 703 print columns in the spit bar area 130 by alternating the high drop weight nozzles 102 and the low drop weight nozzles 104. Leading trench of the fourth die 704 has just entered the spit bar area 103 and prints columns in the spit bar area 130 by alternating the high drop weight nozzles 102 an the low drop weight nozzles 104. The trialing trench 84 of the fourth die 704 is printing an image in the next frame area 120 using just high drop weight nozzles 102. Fifth die 705 has both trenches 82, 84 inside the second frame area 120 and is printing an image by using just high drop weight nozzles 102 of both trenches 82, 84 in a fast printing mode.

As explained above, different address data protocols may be used to address a plurality of activators for firing nozzles 100, wherein each of the activators fires one of the nozzles. Thus, address protocols may allow different firing order and firing frequency when operating the nozzles 100. For example, the data interface to a die 701, 702, 703, 704, 705 including nozzles 100 may support addressing all activators of the die 701, 702, 703, 704, 705 up to 72 KHz, or half of the activators of the die 701, 702, 703, 704, 705 at 144 KHz. Hence, as one example, two print modes may be provided: a high quality mode that uses both the high drop weight and the low drop weight nozzles and a high speed mode that fires just high drop weight nozzles doubling the firing frequency. The firing frequency is changed, such as for example to simultaneously fire both the high drop weight and the low drop weight nozzles 100 inside the spit bar area 130, when both trenches 82, 84 of the die 701, 702, 703, 704, 705 have finished printing the images in the frames 110, 120. Consequently, a gap of print medium between the frame areas 110, 120 and the spit bar areas 130 is not fully used during the change of firing frequency, and thus represents a waste of print medium. Moreover, changing the firing frequency is technically undesired and difficult to achieve in a web press continuously printing on a roll of media.

In the example shown in FIG. 5, the printing inside the spit bar area 130 is performed by the trenches 80 of dies 701, 702, 703, 704, 705 which are located inside the spit bar area 130. Thus, the trenches are printing columns inside the spit bar area 130 by alternating between rows of high drop weight nozzles 102 and rows of low drop weight nozzles 104. This aspect of alternating the nozzles 100 in the spit bar area 130 reduces the number of nozzles which are fired simultaneously, and can for example be used to have the high drop weight nozzles 102 inside the frame areas 110, 120 (first group) and the alternating nozzles 102, 104 inside the spit bar area 130 (second group) operated with the same firing frequency, such as for example the firing frequency representing a high speed mode of the inkjet printer. Consequently, this strategy allows keeping the same firing frequency along the printing job and allows significantly reducing the unused gap between frame areas 110, 120 and spit bars 130.

More specifically, the high and low drop weight nozzles 102, 104 located in a spit bar 130 are alternated at the trench level 80. This means that a small gap of print medium, if any, remains unused by the trenches 80 between the image frames 110, 120 and spit bar areas 130. In the example of a die shown in FIG. 4, the gap can amount to as little as 5 columns at 600 dpi (trailing column finishes to print the image before start alternating drop volumes). Thus, operating the high and low drop weight nozzles 102, 104 by alternately firing nozzles comprised in rows of high drop weight nozzles 102 and in rows of low drop weight nozzles 104, allows keeping the same firing frequency along the job and allows reducing the gap between frame areas 110, 120 and spit bar areas 130.

In an example, the nozzles 100 are operated by receiving column data defining a pattern of nozzles 100 to be fired, and by generating a header indicating a row of high drop weight nozzles or a row of low drop weight nozzles for firing said pattern of nozzles in the spit bar area 130.

Figure 6:
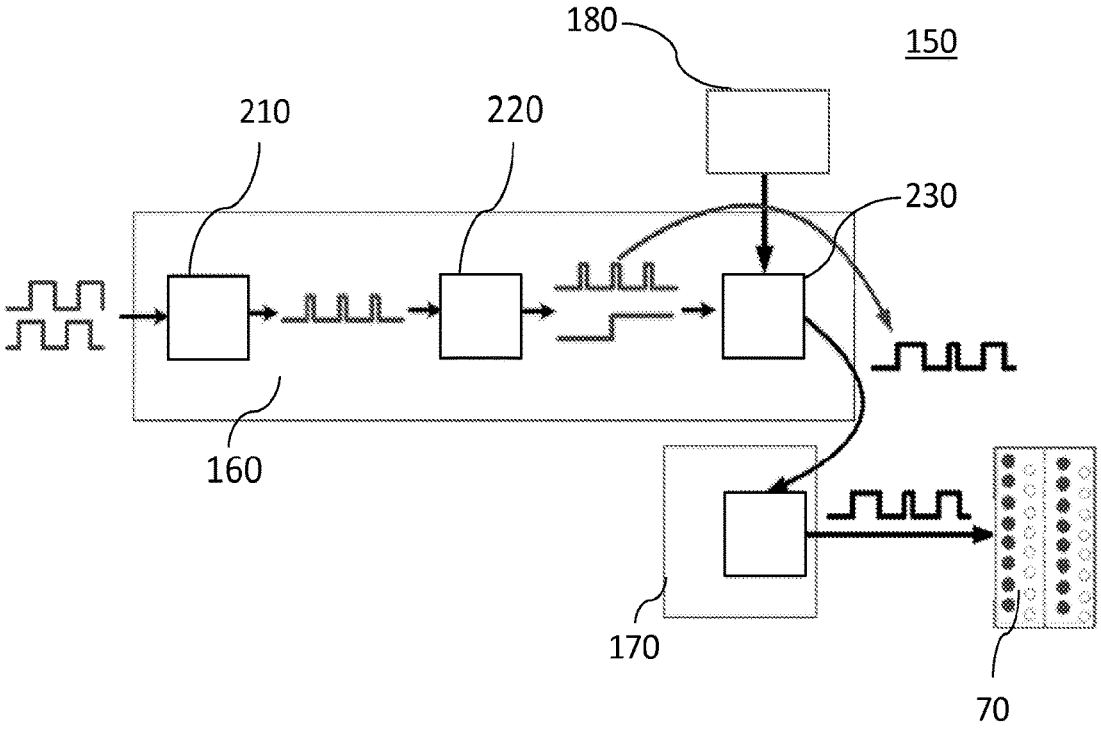
FIG. 6 shows a printing system data path used in a printhead control system.

In this respect, FIG. 6 shows an example of a printing system data path 150 used in the printhead control system 140 to operate the nozzles 100 of a die 70. In this example, a printhead control system 140 comprises the printing system data path 150 illustrated in FIG. 6.

The printing system data path 150 may include a data path FPGA 160 for implementing the printing imaging pipeline, and for performing image processing to prepare the images for printing. A single data path FPGA 160 can be capable of serving several printheads 60. In one stage of the data path FPGA, column data ready to be printed is read from a memory buffer 180 and sent towards a printhead 60 including a die 70, such as to be synchronized with an input encoder 210 that tracks the media speed. In the example of FIG. 6, the encoder 210 receives encoder signals as input and extrapolates them to the printing resolution. For instance, assuming that the encoder native resolution is 150 dpi, the encoder 210 extrapolates by a factor of 4 to print at 600 dpi. The encoder 210 then generates an output signal Csync (Column Synchronization) that provides a pulse every time a column is to be printed. Moreover, it provides the current position at printing resolution. It further may include a printhead FPGA 170 can be placed close to the printhead 60 and serves to control different aspects of the printhead 60 (such as for example printhead voltage regulation). The printhead FPGA 170 also drives column data received from the data path FPGA 160 to the printhead dies 70. The printing system data path 150 also may include printhead die 70 contains, as discussed above, nozzles 100 for ejecting drops when energy is applied to its activators or other print drops generator, and can for example be made of silicon.

Figure 7:
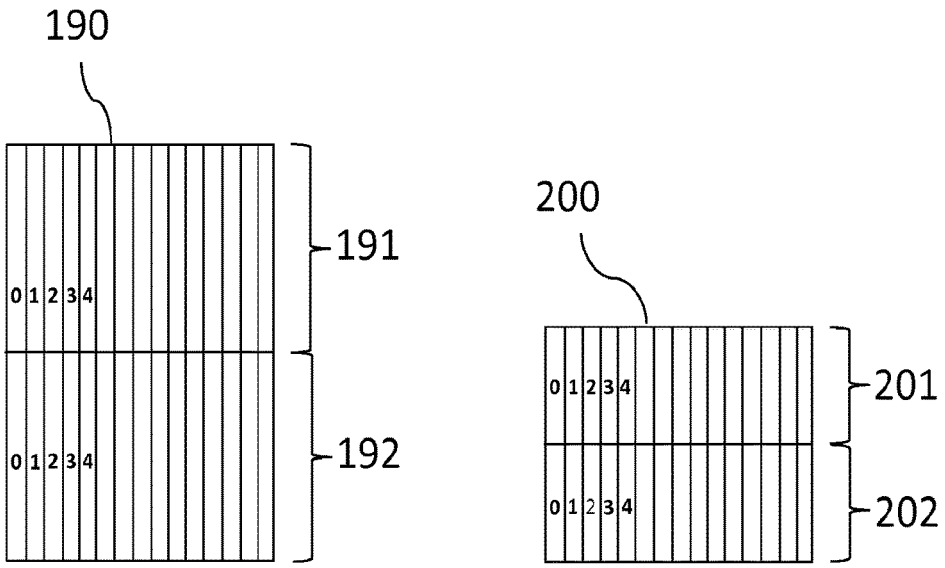
FIG. 7 shows two examples of column data containing a bit per nozzle telling whether a nozzle should fire a drop or not in that specific column.

The memory buffer 180 can represent a DRAM memory where columns ready to be printed are stored. The column data stored in the memory buffer 180 can contain a bit per nozzle telling whether a nozzle should fire a drop or not in that specific column. FIG. 7 shows two examples of column data 190, 200 wherein the column format is different depending on the print mode. The first column data 190 may contain data for both high and low drop weight nozzles in two trenches 191, 192, for example 2112 nozzles per trench, for high quality printing. The second column data 200 may be used for a high speed mode of the inkjet printer 10, because it contains data addressing just half of the nozzles of each of the two trenches 201, 202, for example 1056 nozzles per trench. There can be a different memory buffer 180 for each printhead die 70. In other words, the data path FPGA can be adapted to receive one column data 190, 200 for each dies 70 of a printhead 60.

It follows that the firing frequency can be calculated as the number of columns printed per period of time. Hence, alternating between rows 90 of nozzles containing high drop weight nozzles 102 and rows of nozzles containing low drop weight nozzles 104, inside the spit bar area 130, allows maintaining the same firing frequency along the printing job, and thus allows maintaining the same column data format stored in the memory buffer 180. This simplifies implementation of the printhead control system 140.

The printing system data path 150 further includes a PrintZone generator 220. The PrintZone generator 220 generates a signal per die 70 that defines the window where the die 70 shall print an image. By contrast, the CSync pulses provided by the encoder 210 are generated also in areas where no images have to be printed.

The PrintZone generator 220 also generates a window signal to notify the boundaries between frame areas 110, 120 and spit bar areas 130. This information can be used by the printhead control system 140 to determine when to print just with high drop weight nozzles 102 in the frame areas 110, 120, and when to alternate between high and low drop weight nozzles 102, 104 in the spit bar area 130.

For this purpose, the printing system data path 150 further comprises a drop-to-pens unit 230 which determines when a Csync pulse from the PrintZone generator 220 is within the window where the die 70 should print. The drop-to-pens unit 230 then sends the column data read from the memory buffer 180 to the printhead FPGA 170.

Figure 8:
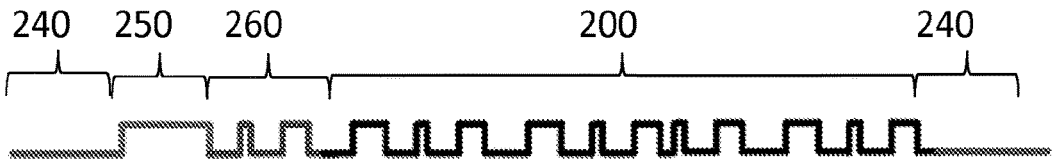
FIG. 8 shows a serial interface data format for sending column data to a printhead FPGA; according to one example.

In an example, the drop-to-pens unit 230 sends the column data 200 to the printhead FPGA 170 using the serial interface data format shown in FIG. 8. Here, the line signal is deasserted when not sending a column, see idle state 240. When the column transaction is about to start, the line is asserted for some cycles with start bits, see initial state 250. Afterwards, a header 260 is sent including information about the column or row of nozzles 100 to be used to print the nozzle pattern defined by the column data 200.

Thus, in case of operating the inkjet printer in high speed mode, the header 260 includes at least one bit per trench 80 indicating whether that trench 80 shall print using a row of high drop weight nozzles 102 or using a row of low drop weight nozzles 104. In an example, the drop-to-pens unit 230 generates different header information 260 for the two trenches 80 such as to account for the distance between the trenches 80 and the frame area/spit bar area boundary information received from the PrintZone generator 220.

It follows that the nozzles 100 are operated by receiving column data 200 defining a pattern of nozzles 100 to be fired, and by generating a header 260 indicating the row of high drop weight nozzles 102 or row of low drop weight nozzles 104 which is to be used for firing said pattern of nozzles 100, for example in the spit bar area 130. Thus, in order to alternate between rows of nozzles 100 for cleaning in the spit bar area 130, it is convenient to alternate header information 260 to indicate whether the respective trench 80 of a die 70 shall print with a row of high drop weight nozzles 102 or with a row of low drop weight nozzles 104.

Figure 9:
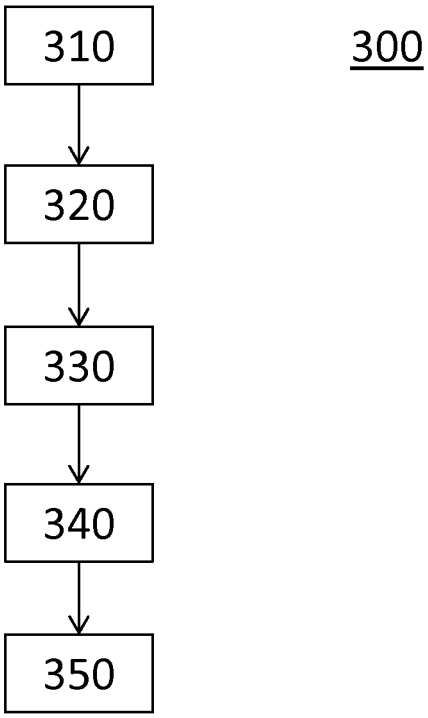
FIG. 9 shows an example of a method for operating a printhead in an inkjet printer.

FIG. 9 discloses an example of a method 300 for operating a printhead 60 in an inkjet printer 10. Here, the printhead 60 includes a plurality of nozzles 100 for jetting ink. The nozzles 100 comprise high drop weight nozzles 102 and low drop weight nozzles 104 and are each arranged to eject ink on a print medium 30. The print medium includes frame areas 110, 120 for printing images and spit bar areas 130 for cleaning the nozzles 100. A discussion on different examples of such inkjet printers 10 is provided above by reference to FIGS. 1 to 8.

As illustrated in FIG. 9, the method for operating a printhead 300 comprises moving the print medium relative to the printhead 310. Moreover, a first group of said nozzles located in a frame area of the print medium and a second group of said nozzles located in a spit bar area of the print medium 320; are determined, and the high drop weight nozzles of the first group are operated such as to eject ink and print an image in the frame area 330. By contrast, the low drop weight nozzles of the first group are disabled such as not to eject ink in the frame area 340. In the spit bar area 350, and the high drop weight nozzles and the low drop nozzles of the second group are operated such as to alternately eject ink.

In other words, just the high drop weight nozzles 102 are used during the print job when printing images in the frame areas 110, 120. Then, when the nozzles arrive at the spit bar area 130 located between frame areas 110, 120, the high drop weight nozzles 102 and the low drop nozzles 104 are operated to alternately eject ink in the spit bar area 130. In this way, both the high drop weight nozzles 102 and the low drop nozzles 104 are cleaned inside the spit bar area 130 such as to avoid decap issues, whereas just the high drop weight nozzles 102 are used to print images in the frame areas 110, 120, for example during a fast mode of printing.

As discussed above, operating the high drop weight nozzles 102 and the low drop nozzles 104 to alternately eject ink in the spit bar area 130 allows to maintain that the same firing frequency along the printing job, and a practically zero gap of unused print medium results between frame areas 110, 120 and the spit bar area 130.

In an example, the high drop weight nozzles of the first group and the alternating nozzles of the second group are operated with the same firing frequency, for example with a firing frequency representing a high speed mode of the inkjet printer. As discussed above, operating the nozzles without changing the firing frequency simplifies the implementation of the method and system, and further simplifies the memory format for storing the image information used for printing.

In a further example, operating the nozzles comprises ejecting ink by firing nozzles which are included in a row of high drop weight nozzles, or in a row of low drop weight nozzles. For example, the method can include receiving column data defining a pattern of nozzles to be fired, and generating a header indicating whether the row of high drop weight nozzles 102 or the row of low drop weight nozzles 104 shall be used for firing said pattern of nozzles in the spit bar area 130. In this way, and as discussed above, it is convenient to alternate header information 260 to indicate whether the respective trench 80 of a die 70 shall print with a row of high drop weight nozzles 102 or with a row of low drop weight nozzles 104, for example in order to alternate between rows of nozzles 100 being cleaned in the spit bar area 130.

The invention claimed is:

1. A method for operating a printhead in a printer, wherein the printhead includes a plurality of nozzles for ejecting a printing fluid on a print medium, the nozzles comprise high drop weight nozzles and low drop weight nozzles ejecting drops of different drop weight, and arranged to eject printing fluid on the print medium such as to print images in frame areas of the print medium and such as to clean nozzles in spit bar areas of the print medium, the method comprising:

moving the print medium relative to the printhead;

determining a first group of said nozzles located over a frame area of the print medium and a second group of said nozzles located over a spit bar area of the print medium;

operating the high drop weight nozzles of the first group such as to eject printing fluid and print an image in the frame area;

disabling the low drop weight nozzles of the first group such as not to eject printing fluid in the frame area;

operating the high drop weight nozzles and the low drop weight nozzles of the second group such as to alternately eject printing fluid in the spit bar area.

2. The method according to claim 1, wherein the high drop weight nozzles of the first group and the alternating nozzles of the second group are operated to eject printing fluid with the same firing frequency.

3. The method according to claim 2, wherein the high drop weight nozzles of the first group and the alternating nozzles of the second group are operated to eject printing fluid with a firing frequency corresponding to a high speed mode of the inkjet printer.

4. The method according to claim 1, wherein operating the high drop weight nozzles of one of said groups comprises ejecting printing fluid by firing nozzles comprised in a row of high drop weight nozzles.

5. The method according to claim 4, wherein operating the first and second groups of nozzles comprises receiving column data defining a pattern of nozzles to be fired, and generating a header indicating the row of high drop weight nozzles for firing said pattern of nozzles in the spit bar area.

6. The method according to claim 1, wherein operating the low drop weight nozzles of said second groups comprises ejecting printing fluid by firing nozzles comprised in a row of low drop weight nozzles.

7. The method according to claim 5, wherein operating the first and second group of nozzles comprises receiving column data defining a pattern of nozzles to be fired, and generating a header indicating the row of low drop weight nozzles for firing said pattern of nozzles in the spit bar area.

8. A printhead control system for a printer, wherein the printer includes at least one printhead comprising a plurality of nozzles for ejecting printing fluid, wherein the nozzles include high drop weight nozzles and low drop weight nozzles ejecting drops of different drop weight, and arranged to eject printing fluid on a print medium such as to print images in frame areas of the print medium and such as to clean nozzles in spit bar areas of the print medium; the printer further includes a transport unit for moving the print medium relative to the printhead;

the printhead control device including:

a module to determine a first group of said nozzles located over a frame area of the print medium and a second group of said nozzles located over a spit bar area of the print medium;

a module to operate the high drop weight nozzles of the first group such as to eject printing fluid and print an image in the frame area;

a module to disable the low drop weight nozzles of the first group such as to not eject printing fluid in the frame area; and a module to operate the high drop weight nozzles and the low drop weight nozzles of the second group such as to alternately eject printing fluid in the spit bar area.

9. The printhead control system according to claim 8, further including a module to operate the high drop weight nozzles of the first group and the alternating nozzles of the second group to eject printing fluid with the same firing frequency.

10. The printhead control system according to claim 8, further comprising a datapath FPGA receiving column data from a memory buffer, wherein the column data contains a pattern of nozzles to be fired by nozzles of a die of the printhead, the die comprises at least two trenches of nozzles, and each of the trenches comprises at least one row of high drop weight nozzles and at least one row of low drop weight nozzles.

11. The printhead control system according to claim 10, wherein the datapath FPGA generates a header indicating the row of nozzles for firing said pattern of nozzles in the spit bar area.

12. The printhead control system according to claim 10, wherein the printhead comprises a plurality of said dies, wherein the datapath FPGA receives one column data for each of the dies.

13. An inkjet printer system comprising:

at least one printhead including a plurality of nozzles for ejecting printing fluid, wherein the nozzles include high drop weight nozzles and low drop weight nozzles ejecting drops of different drop weight, and arranged to eject printing fluid on a print medium such as to print images in frame areas of the print medium and such as to clean nozzles in spit bar areas of the print medium;

a transport unit for moving the print medium relative to the printhead; and a printhead control device including:

a module to determine a first group of said nozzles located in a frame area of the printing paper and a second group of said nozzles located in a spit bar area of the printing paper;

a module to operate the high drop weight nozzles of the first group such as to eject printing fluid and print an image in the frame area;

a module to disable the low drop weight nozzles of the first group such as not to eject printing fluid in the frame area;

a module to operate the high drop weight nozzles and the low drop weight nozzles of the second group such as to alternately eject printing fluid in the spit bar area, and a module to operate the high drop weight nozzles of the first group of nozzles and the alternating nozzles of the second group of nozzles with the same firing frequency.

14. The inkjet printer system according to claim 13, further comprising a datapath FPGA receiving column data from a memory buffer, wherein the column data contains a pattern of nozzles to be fired by nozzles of a die of the printhead, the die comprises at least two trenches of nozzles, and each of the trenches comprises at least one row of high drop weight nozzles and at least one row of low drop weight nozzles.

15. The inkjet printer system according to claim 14, wherein the datapath FPGA generates a header indicating the row of nozzles for firing said pattern of nozzles in the spit bar area.

* * * * *